United States Patent [19]

Takehara

[11] Patent Number: 4,908,920

[45] Date of Patent: Mar. 20, 1990

[54] FIBER CRIMPING APPARATUS

[75] Inventor: Katsuomi Takehara, Mukou, Japan

[73] Assignee: Kabushiki Kaisha Takehara Kikai Kenkyusho, Prefecture of Kyoto, Japan

[21] Appl. No.: 260,516

[22] Filed: Oct. 20, 1988

[30] Foreign Application Priority Data

Oct. 31, 1987 [JP] Japan ..... 62-276950
Jul. 16, 1988 [JP] Japan ..... 63-177528

[51] Int. Cl.[4] ..... D02G 1/12
[52] U.S. Cl. ..... 28/263
[58] Field of Search ..... 28/221, 250, 251, 255, 28/256, 263, 264

[56] References Cited

U.S. PATENT DOCUMENTS

T925,009 8/1974 Faw et al. ..... 28/256
3,096,558 7/1963 Ralnard et al. .
3,137,055 6/1964 Ralnard et al. .
3,248,770 5/1966 Shattuck et al. .
3,367,005 2/1968 Clarkson ..... 28/256
3,935,621 2/1976 Weber ..... 28/263
4,157,604 6/1979 Oswald et al. ..... 28/221

FOREIGN PATENT DOCUMENTS 1408253 10/1975 United Kingdom .

*Primary Examiner*—Werner H. Schroeder
*Assistant Examiner*—Bradley K. DeSandro
*Attorney, Agent, or Firm*—Wenderoth, Lind & Ponack

[57] ABSTRACT

Apparatus for crimping fibers comprises a ring roller of a comparatively large diameter which rotates in one direction and an inscribed roller which contacts the inner surface of said ring roller and which rotates in the same direction at the same velocity as the ring roller while holding bundles of fibers to be crimped between the two rollers and side rings which are situated on both sides of the place of contact of the two rollers and which rotate in the same direction at the same velocity as these rollers, and by forming the surrounding of a stuffing box by said rollers and rings.

6 Claims, 5 Drawing Sheets

FIBER CRIMPING APPARATUS

BACKGROUND OF THE INVENTION

1. Field of the Invention

The present invention relates to a fiber crimping apparatus which is designed to give waves to the synthetic fibers formed straight by fiber drawing devices, and particularly the fiber bundles are delivered out into the stuffing box by means of two nip rollers which press against each other.

2. Description of the Prior Art

The conventional fiber crimping apparatus equipped with two nip rollers is of two kinds; the one kind, as referred to in U.S. Pat. Nos. 3,096,558, 3,137,055 and 3,248,770, is an outer contact type in which fiber bundles are passed between two rollers the outer surfaces of which are pressed against each other and rotate at the same speed; the other kind, as referred to in U.K. Pat. No. 1,408,235, is an inner contact type in which a ring roller, the inner surface of which is formed on the contacting surface, is made to contact the internally contacting roller, which has an eccentric rotating shaft and the outer surface is formed on the contacting surface and a crescent shaped stuffing box is formed between the two rollers.

The above-mentioned outer contact type conventional apparatus has a drawback that the nip zone, which is formed in the front and the rear of the roller contacting point, is too short. On the other hand, the internally contacting type has such the advantage that the nip zone can be larger. In the outer contact type conventional apparatus, the fibers tend to scatter along the rotating direction of each roller when they pass the place of contact of the rollers and enter the stuffing box. For preventing such scatter of fibers, it was necessary to fit a scraper to each roller and lead the fibers to the stuffing box exactly. But, the fibers are pressed out through a gap of the scraper at so high rate that very delicate processing and assembling adjustment were required for preventing such pressing out of the fibers. Further, because of such structure that the stuffing box situated at the rear of the rotating direction of the roller was surrounded by fixed side walls, there were such defects as the fibers fly out of the stuffing box through a gap between the side walls and the roller and/or friction heat is produced by a difference in velocity at the time when the bundles of fibers fed into the stuffing box at a high speed come in contact with the fixed side walls and thus the fibers are damaged. For that reason, it has been expected to improve the crimping apparatus in order to eliminate the abovementioned defects of the crimping apparatus of a roller system and to speed up crimping process.

This sort of drawback also exists in the internal contact roller type apparatus. That is in this type apparatus in which a crescent shaped stuffing box is formed between the two rollers that contact internally and one side of the said box which is open, is closed with a cover plate; one side out of four sides is formed by a fixed wall surface, a small gap is formed between the said cover plate and the two rotating rollers, and the abovementioned facts caused such troubles as the fiber escapes out of the box through the said gap, the flowing fibers generate heat by contacting the cover plate, all of which affect the production of uniform crimp. For this reason, there has been a problem of eliminating the drawback of mechanical fiber feeding using two rollers, of speeding-up of the crimping process and of developing an apparatus which enables production of crimped yarn of more uniform crimping and highly reliable results.

SUMMARY OF THE INVENTION

This invention provides a fiber crimping apparatus characterized in that it consists of a ring roller of a comparatively large diameter rotating in one direction and another roller, which is installed to contact the said roller internally, and which, while holding the fiber bundle between itself and the said roller, rotates in the same direction at the same surface speed; a side ring, which rotates in the same direction at the same speed with the said two rollers, is installed on both sides of the contacting points of the said two rollers to let the inner surface of the side ring at both sides and the contact surface of the two rollers form a stuffing box having four surfaces which run continuously at the rear part of the direction of rotation of the said contact point.

In the apparatus according to the invention, constructed as described above, a pair of outer and inner rollers, which hold the fibers to be crimped, rotate in the same direction at the same speed. The fiber bundle, which becomes flat while being pressed by two rollers, is fed into the stuffing box, being guided on both front and back sides by the double rotating surfaces of the inner and outer roller the direction of rotation of which is the same even after pressing with each other. And the fiber bundle, which becomes flat, between the two rollers, is lead into the inner surface of the side ring which rotates in the same direction at the same speed, and therefore there will be no heat generation as in the case of the fixed surface, there will be no flow of the fibers from the gap, and the fibers are guided in good order into the stuffing box. In this way, the four surfaces that form the stuffing box run in the flowing direction of the fibers, the difference of the speed is made small to prevent generation of heat by friction and to prevent the fibers from flowing out, which enables crimping to be carried out at a higher speed, thus eliminating the drawbacks of the conventional apparatus.

BRIEF DESCRIPTION OF THE DRAWINGS

The drawings show the examples of embodiment of the present invention.

DETAILED DESCRIPTION OF THE PREFERRED EMBODIMENT

Figure 1:
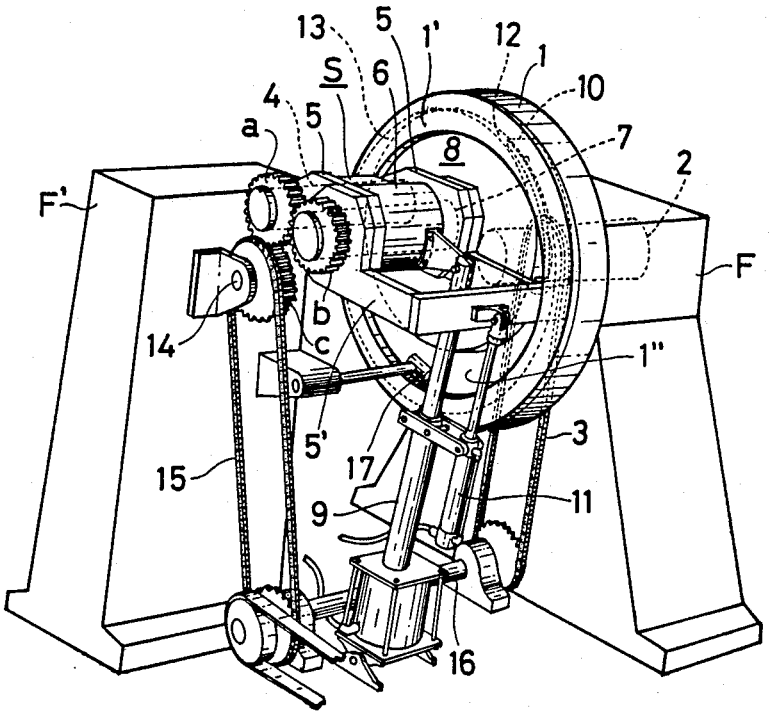
FIG. 1 is an oblique view to show the working example I of the present invention.
Figure 2:
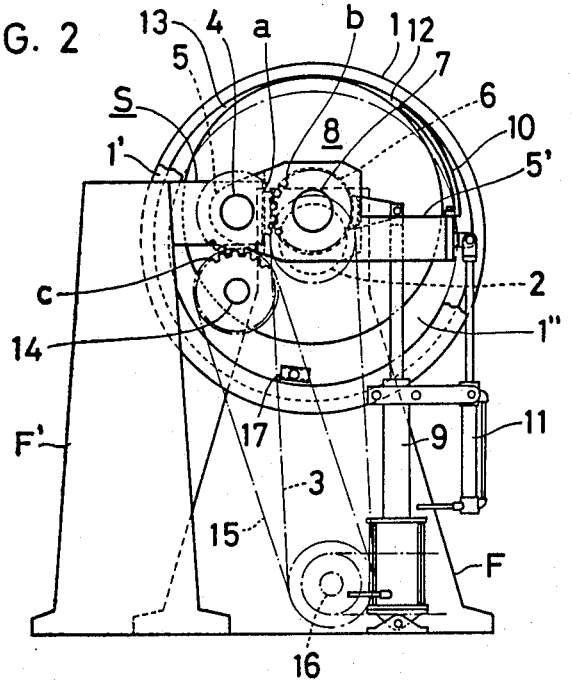
FIG. 2 is an elevation with partial cut-off of FIG. 1.
Figure 3:
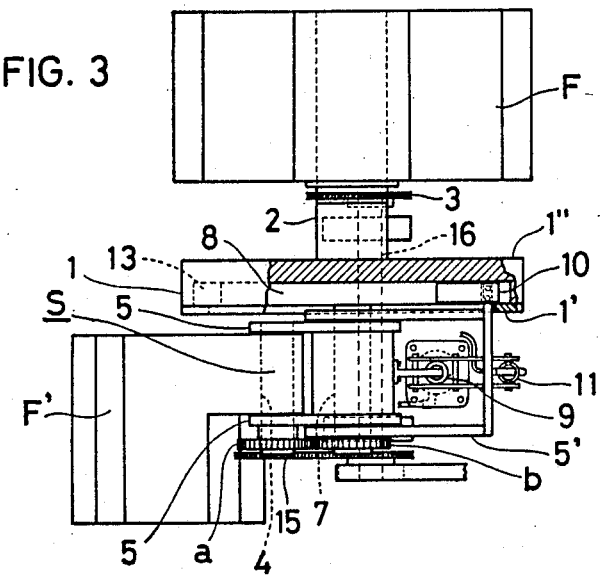
FIG. 3 is a plane view with partial cut-off of FIG. 2.
Figure 5:
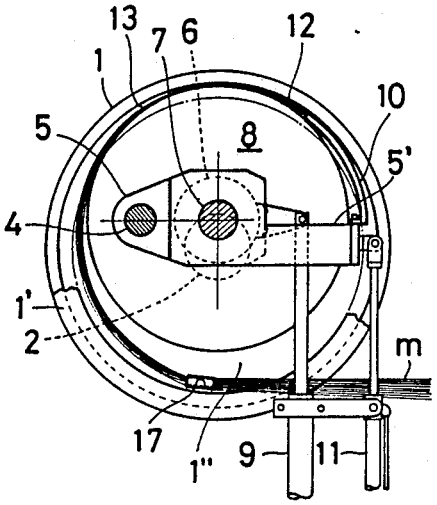
FIG. 5 is an elevation with partial cut-off to show the state that the bundles of fibers are crimped due to the contact with the crimp resisting object in the working example I.
Figure 6:
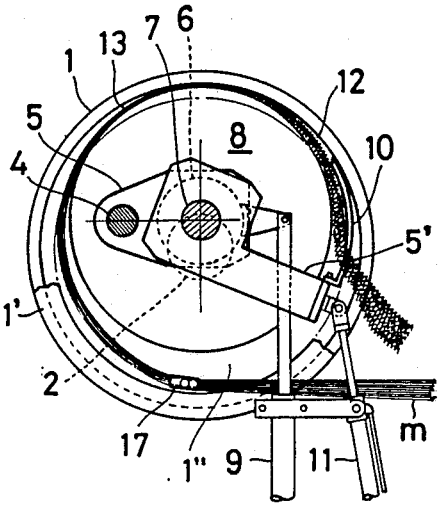
FIG. 6 is an elevation to show the state that the amount of the crimped bundles of fibers increases and that the crimp resisting object moves backward and that the crimped bundles of fibers are discharged from the machine successively.
Figure 4:
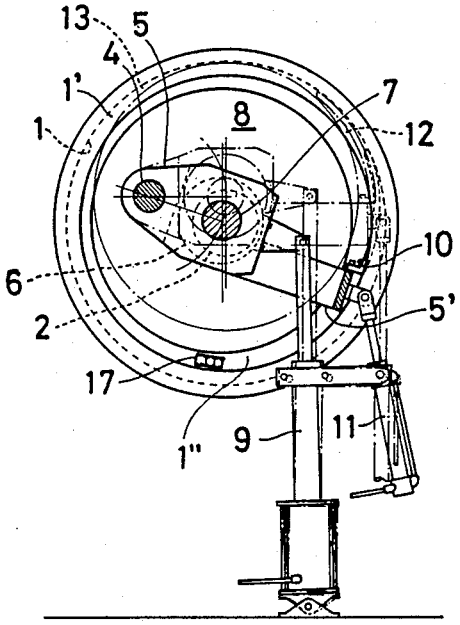
FIG. 4 is an elevation with partial cut-off at the time when releasing the contact of the inscribed roller with the ring roller in order to hold the bundles of fibers between the two rollers in the working example I.
Figure 7:
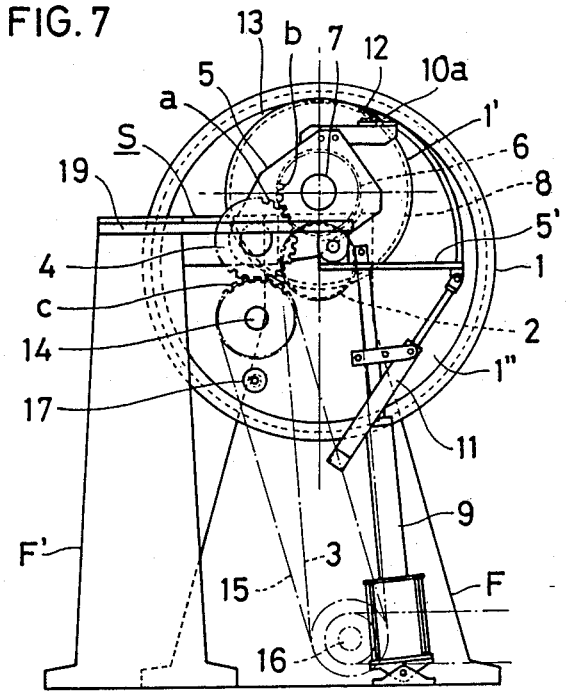
FIG. 7 is an elevation with partial cut-off to show the working example II.
Figure 8:
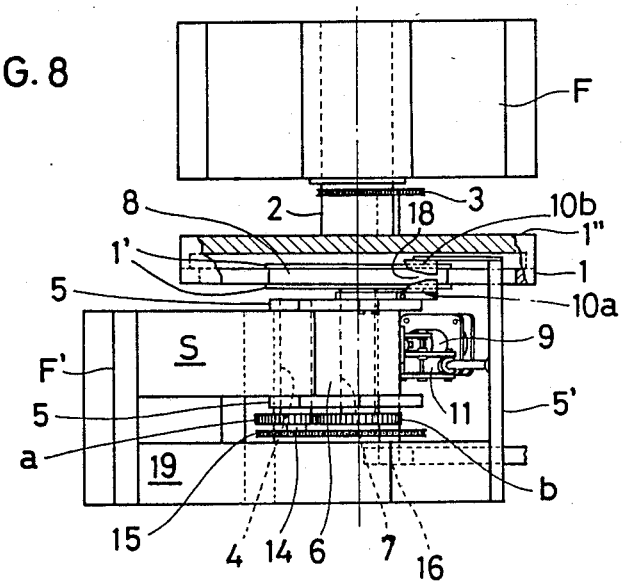
FIG. 8 is a plane view with partial cut-off of FIG. 7.
Figure 9:
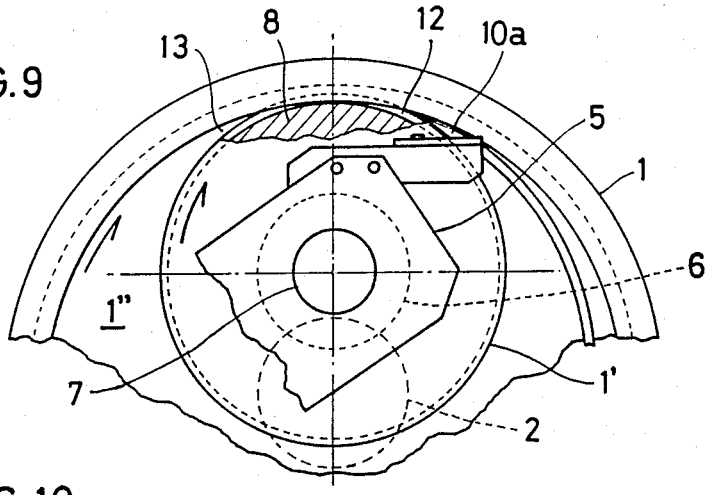
FIG. 9 is a magnified elevation to show the important points of FIG. 7.
Figure 10:
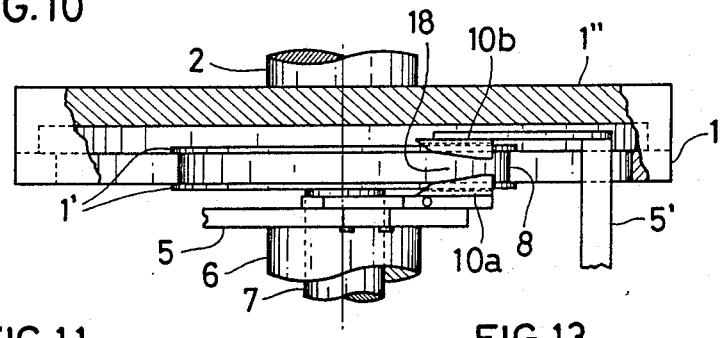
FIG. 10 is a plane view with partial cut-off of FIG. 9.
Figure 11:
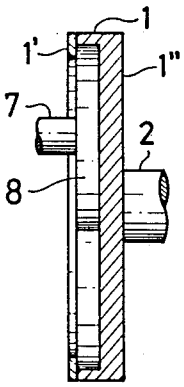
FIG. 11 is a vertical sectional side view to show the state that one of the two side rings is formed by the hub of the ring roller and that the other side ring is fitted to the other side of the ring roller as one body.
Figure 12:
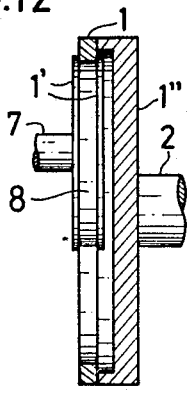
FIG. 12 is a vertical side view to show the state that the side rings are formed on both sides of the inscribed roller respectively as one body.
Figure 13:
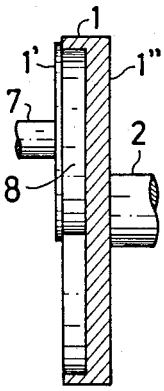
FIG. 13 is a vertical sectional side view to show the state that one side ring is formed on one side of the inscribed roller and that the hub of the ring roller acts as the other side ring.

Now, the apparatus made according to the invention is explained below with references to the preferred in FIGS. 1–13 of the attached drawings.

In the working example I shown in FIGS. 1–6, (1) is a ring roller with a L-shape section which is formed as one body by the outer surface of a hub (1″) fitted on a rotary shaft (2) laid on one side of a machine stand (F) in a cantilever state, and an open side of which is fitted with a side ring (1′) formed separately, and which is rotated by a transmitting device (3); (4) is an intermediary rotary shaft laid on a supporting department (S) of a machine stand (F′) in parallel with said rotary shaft (2); (5),(5) are swing arms, each of which is loosely put on said intermediary rotary shaft (4) in such way as they can swing freely with the rotary shaft (4) as a fulcrum; (6) is a swing bearing matter held firmly between the inner part of the top of the swing arms (5), (5); (5′) is a swing frame of a channel shape with one side open (shape), both ends of which are loosely put on a rotary shaft (7) provided in such way as it passes through the swing arms (5),(5) and the swing bearing matter (6), and which can swing freely with said rotary shaft (7) as a fulcrum; the rotary shaft (7) is fitted on its one end with a gear (b) which engages with a gear (a) fixed to the outer end of the intermediary rotary shaft (4) and is fitted on its outer end with an inscribed roller (8) for contacting the ring roller (1) internally; (9) is a fluid pressure device, the upper end of which is connected to the swing bearing matter (6) and which pushes the inscribed roller (8) to the ring roller (1) or pull the former apart the latter by expanding or contracting; (10) is a crimp resisting object, the base of which is supported on one side of the top end of the swing frame (5′), and the top of which is placed adjacent to the place of contact of the ring roller (1) and the inscribed roller (8), and which can move freely and elastically; (11) is the second fluid pressure device, the upper end of which is connected to the top end of the swing frame (5′), and which supports the crimp resisting object (10) elastically; (12) is a stuffing box formed at the rear of the rotating direction of the place of contact of the ring roller (1) and the inscribed roller (8). The stuffing box (12) in the working example I is surrounded on its four sides by the inner surface of the ring roller (1), the outer surface of the inscribed roller (8), the side ring (1′) fitted on one side of the ring roller (1), and the abovementioned hub (1″) which acts as the other side ring. And at the rear of it, the said crimp resisting object (10) is situated; (13) is a fiber feeding department formed in the front of the rotating direction of the place of contact of the ring roller (1) and the inscribed roller (8); (m) is a bundle of fibers which is fed from the feeding department (13) and held between the ring roller (1) and the inscribed roller (8) and flattened due to the pressure of the two rollers and fed into the stuffing box; (17) is a guide for the bundles of fibers (m) provided outside the feeding department (13).

The rotary shaft (7) of said inscribed roller (8) moves in accordance with a main shaft (16) laid at the lower part of the machine stand (F′) through a driving shaft (14) having a gear (c) which engages with said gear (b) through intermediate gear (a) and another transmitting device (15) which drives said driving shaft (14), and it rotates in such way as the peripheral velocity of the outer surface of the inscribed roller (8) conforms to the peripheral velocity of the inner surface of the ring roller (1) which rotates through said transmitting device (3).

In the working example I having a structure as stated above, the bundles of fibers (m) are held flat between the ring roller (1) and the inscribed roller (8) which rotate in the same direction at the same velocity and are fed into the stuffing box (12). When leaving the place of contact of the two rollers (1) and (8), the bundles of fibers (m) are given a movement in the same direction and the same velocity. By means of both the side ring (1′) and the hub (1″), which also has the function of the other side ring, movement in the same direction and at almost the same speed is given. The bundles of fibers thus flattened come into contact with the crimp resisting object (10) and cause the same crimping action as seen in the case of conventional crimping apparatus of roller system. As the amount of the bundles of fibers crimped in a folded over state in the stuffing box increases, said crimp resisting object (10) resists the second fluid pressure device (11) and moves backward along the inner surface of the ring roller (1) elastically together with the top of the swing frame (5′) which moves with the other rotary shaft (7) as a fulcrum. Thereby, a side of the stuffing box (12) is open wide and the crimped bundles of fibers (m) are discharged from the head successively sideward through a gap between the ring roller (1) and the inscribed roller (8) which are opened at the rear of the stuffing box (12). Said second fluid pressure device (11) repeats such actions as moving forward again the crimp resisting object (10) which has decreased resistance due to the said discharge of the bundles of fibers (m) and moving it back when the resistance increases in accordance with the feed of the bundles of fibers (m). Further, the other fluid pressure device (9) is operated when holding the bundles of fibers (m) between the rollers (1) and (8) in such way as it separates the inscribed roller (8) from the place of contact and holds the bundles of fibers (m) elastically.

Now, the working example II is described below with referenced to FIGS. 7–10.

The working example II is different from the working example I in such point as the side ring (1′) is formed as one body on both sides of the inscribed roller (8) and in such point as two crimp resisting objects (10*a*), (10*b*) are provided on both sides of the rear of the stuffing box in such way as the distance between the insides of the resisting object (10*a*), (10*b*) facing each other is made a resisting space (18), having a wide entrance and a narrow exit to suit crimping of the bundles of fibers (m).

In the working example II, both sides of the place of contact of the ring roller (1) and the inscribed roller (8) are closed by the side rings (1′),(1′) which are respectively fitted on both sides of the inscribed roller (8) as one body and which rotate together with the inscribed roller (8), and the bundles of fibers (m) are led to the resisting space (18) formed between the two crimp resisting objects (10a) and (10b) provided at the rear of the stuffing box (12), and then the crimped bundles of fibers (m) are discharged successively sideward through a gap between the ring roller (1) and the inscribed roller (8) which are opened at the rear of the crimp resisting objects (10*a*), (10*b*).

The ring roller (1) in the working example II is rotated, same as in the working example I, by fitting the hub (1″) on the rotary shaft (2) laid on one side of the machine stand (F) in a cantilever state. Further, the inscribed roller (8) is fitted, same as in the working example I, on the rotary shaft (7) which passes through the swing arm (5) swung by the action of the fluid pressure device (9) with the intermediary rotary shaft (4) as a fulcrum and the swing bearing matter (6) provided at the top of said swing arm (5). The gear (b) situated at the outer end of said rotary shaft (7) engages with the gear (a) situated at the outer end of the intermediary rotary shaft (4). The rotary shaft (7) is connected with the main shaft (16) through a driving shaft (14) having a gear (c) which engages with the gear (a) and the transmitting device (15). The inscribed roller (8) is rotated at the same velocity at the place of contact with the ring roller (1) driven by said main shaft (16) through another transmitting device (3).

Between said two crimp resisting objects, one resisting object (10a) is fitted its base on the outside of said swing arm (5) and comes close or parts from the ring roller (1) together with the inscribed roller (8) by the action of said fluid pressure device (9). The other crimp resisting object (10b) is fixed its base on the swing arm (5′) provided at the top of a supporting lever (19) extended from the machine stand (F′) in such way as it can swing freely and is supported in a fixed position at the rear of the stuffing box by another fluid pressure device (11), the top of which is connected to the swing arm (5′) and which is supported in the middle of said fluid pressure device (9) and engages in contacting and parting from the bundles of fibers (m) before and after crimping process and adjusting the fixed position. Further, (13) is a fiber feeding department formed in the front of the rotating direction of the place of contact of the ring roller (1) and the inscribed roller (8); (17) is a guide for feeding the bundles of fibers (m) to be crimped to the feeding department (13).

When carrying out the present invention, the shape or style of the crimp resisiting object (10) is not limited to what is described in the working example. It may vary depending upon the nature of the fiber to be crimped or the processing speed.

When working the present invention, it is optional according to the property of the material to be processed or the speed of processing whether the crimp resisting object (10) is provided in a freely movable state or in a fixed state. It is also optional to place the crimp resisting object (10) along the outer surface of the inscribed roller (8) or along respectively the inner surface of the ring roller (1) and the outer surface of the inscribed roller (8). Its shape and other things too are optional. Further, it is optional in accordance with the essentials of the present invention to form one side ring (1′) on one side of the inscribed roller (8) and to let the hub (1″) of the ring roller (1) act as another side ring (1′).

As stated above, according to the present invention in which the bundles of fibers to be crimped are held between the ring roller and the inscribed roller provided in order to contact said ring roller internally and the two rollers are rotated in the same direction to each other and the four sides of the stuffing box is formed by closing both sides of the place of contact of said two rollers by the side rings which rotate in the same direction at the same velocity, the surface and back of the bundles of fibers flattened by the pressure of the rollers are led to the rotating surface of the rollers running in the same direction when the bundles of fibers part from the place of contact and both sides of the bundles of fibers too are led to the inner surface of the side rings which rotate in the same direction at the same velocity, as the result of which the bundles of fibers are fed into the stuffing box in good order without breaking their flat belt shape and preventing the flying out of fibers from the surface of the flattened belt shape. In other words, according to the present invention, the four sides of the stuffing box go forward in the running direction of the fibers, so that no disorder of the fibers or no production of friction heat as seen in the case of conventional devices takes place. Accordingly, the present invention has such effects as the speed of crimp processing can be increased remarkably and it is very suitable for the speed-up of the machine operation.

I claim:

1. Fiber crimping apparatus comprising:

a ring roller of a comparatively large diameter rotating in one direction and having an internal contacting surface, and a further roller mounted within said ring roller and having an outer contact surface contacting said internal contacting surface of said ring roller at a contact point, said further roller and said ring roller being rotatatable in the same direction at the same contacting surface speed; and side ring means rotatable in the same direction and at the same speed as ring roller and said further roller and positioned on both sides of said contact point, the surfaces of said side ring means facing toward each other and the contacting surfaces of said two rollers forming on the downstream side of said contacting point a stuffing box having four surfaces which run continuously in the direction of rotation of said rollers at said contact point.

2. Fiber crimping apparatus as claimed in claim 1 in which said ring roller has a hub thereon constituting one of said side ring means, and said other side ring means is a side ring mounted on the other side of said ring roller.

3. Fiber crimping apparatus as claimed in claim 1 in which said side ring means comprises side rings mounted on both sides of said further roller.

4. Fiber crimping apparatus as claimed in claim 1 in which said ring roller has a hub thereon constituting one of said side ring means, and said other side ring means is a side ring on the other side of said further roller.

5. Fiber crimping apparatus as claimed in claim 1 further comprising a crimping resisting object at the downstream side of said stuffing box and having an end directed toward said contacting point, and means for resiliently moving said crimping resisting object in the direction of the path of fiber through said stuffing box.

6. Fiber crimping apparatus as claimed in claim 5 in which said crimping resisting object has two opposed parts on opposite sides of the path of the fiber through the stuffing box, said parts defining between them an opening having a wide entrance portion in the direction toward the contacting point and a narrow portion in the direction away from the contacting point.

* * * * *